US009109793B2

(12) United States Patent
Menow et al.

(10) Patent No.: US 9,109,793 B2
(45) Date of Patent: Aug. 18, 2015

(54) ILLUMINATED DISPLAY UNIT

(75) Inventors: Steve Menow, Morrisville, PA (US); Robert Henry, Bethlehem, PA (US); Anthony Wyzen, Northhampton, PA (US); David A. Cziraky, Bethlehem, PA (US)

(73) Assignee: Crayola, LLC, Easton, PA (US)

( * ) Notice: Subject to any disclaimer, the term of this patent is extended or adjusted under 35 U.S.C. 154(b) by 1088 days.

(21) Appl. No.: 12/839,617

(22) Filed: Jul. 20, 2010

(65) Prior Publication Data

US 2011/0013375 A1 Jan. 20, 2011

Related U.S. Application Data

(60) Provisional application No. 61/226,926, filed on Jul. 20, 2009.

(51) Int. Cl.

| | |
|---|---|
| ***A63H 1/24*** | (2006.01) |
| ***F21V 33/00*** | (2006.01) |
| ***A63H 33/22*** | (2006.01) |
| *F21S 10/00* | (2006.01) |
| *F21S 10/06* | (2006.01) |

(52) U.S. Cl.

CPC ..... *F21V 33/008* (2013.01); *A63H 33/22* (2013.01); *F21S 10/005* (2013.01); *F21S 10/06* (2013.01)

(58) Field of Classification Search

CPC ..... F21V 33/008; A63H 33/22
USPC ..... 362/249.16, 249.14, 249.06, 604, 605, 362/619, 628, 334, 318, 186; D21/469; D20/21

See application file for complete search history.

(56) References Cited

U.S. PATENT DOCUMENTS

| | | | | |
|---|---|---|---|---|
| 4,649,280 | A | 3/1987 | Holland | |
| 4,791,745 | A | 12/1988 | Pohn | |
| 4,949,489 | A | 8/1990 | Rudell et al. | |
| 5,324,224 | A * | 6/1994 | Anderson et al. | 446/91 |
| 6,028,977 | A | 2/2000 | Newsome | |
| 6,283,604 | B1 * | 9/2001 | Liao | 362/84 |
| 6,601,964 | B2 * | 8/2003 | Wang et al. | 362/84 |
| 7,264,367 | B2 | 9/2007 | Hulse | |
| D577,075 | S * | 9/2008 | Bode | D20/43 |
| 7,430,355 | B2 | 9/2008 | Heikenfeld et al. | |
| 7,537,947 | B2 | 5/2009 | Smith et al. | |

(Continued)

FOREIGN PATENT DOCUMENTS

WO 2004099664 A1 11/2004

*Primary Examiner* — Nimeshkumar Patel
*Assistant Examiner* — Christopher Raabe
(74) *Attorney, Agent, or Firm* — Shook, Hardy & Bacon, LLP

(57) ABSTRACT

An illuminated-display unit useable to provide artwork with rotating, glowing effects is described. The illuminated-display unit includes a base, a plate, and a dome. The base has a top surface with a central receptacle and an annular channel, a control panel, and light sources housed therein. The plate is disposed within the receptacle and the dome is disposed on the base to engage the annular channel and thereby accept the plate within its interior. Ink drawings or artwork are drawn on surfaces of the plate and the dome. The light sources are illuminated to provide internally reflected light within the plate and base. The ink on the plate and base refracts the internally reflected light and/or chemically or physically reacts thereto to provide a glowing effect. The dome and/or the plate are rotatable manually or mechanically to provide an animated effect to the illuminated display.

20 Claims, 6 Drawing Sheets

(56) References Cited

U.S. PATENT DOCUMENTS

| | | | | |
|---|---|---|---|---|
| 7,594,349 | B2 | 9/2009 | Rudell et al. | |
| 2004/0093776 | A1 * | 5/2004 | Laun | 40/409 |
| 2005/0201899 | A1 | 9/2005 | Weisbuch | |
| 2005/0271452 | A1 * | 12/2005 | Yu et al. | 401/123 |
| 2006/0188873 | A1 | 8/2006 | Abel et al. | |
| 2006/0268541 | A1 * | 11/2006 | Schou | 362/171 |
| 2008/0113578 | A1 * | 5/2008 | McAlaine et al. | 446/75 |
| 2009/0233265 | A1 * | 9/2009 | Budryk et al. | 434/412 |
| 2010/0053952 | A1 * | 3/2010 | Levon | 362/235 |

* cited by examiner

ILLUMINATED DISPLAY UNIT

CROSS-REFERENCE TO RELATED APPLICATIONS

This application claims priority to Provisional Patent Application No. 61/226,926 filed Jul. 20, 2009 which is hereby incorporated by reference herein in its entirety.

BACKGROUND

Many drawing display units are known in the art, such as, for example, chalkboards, dry erase boards, or simply a frame or an easel on which to place a work piece. Generally, such units are designed to display drawings and artwork under daylight or well lit conditions. The units may also utilize various light sources in order to adequately illuminate a drawing or artistic composition for viewing by observers. The lighting illuminates the entire work, including any drawings and a substrate on which the drawings are created. These devices do not take advantage of clear drawing substrates or unique illumination characteristics available therein.

SUMMARY

Embodiments of the invention include an illuminated-display unit having a base, a clear plate, and a clear dome. A user draws one or more drawings, images, or other figures on surfaces of the plate and the dome. The plate is then received by a top surface of the base via a receptacle thereon. The dome is placed on the base and receives the plate within an interior void of the dome. A user activates one or more light sources housed within the base in order to illuminate the drawings placed on surfaces of the plate and the dome. When viewed under low ambient light conditions, the drawings on the plate and the dome are illuminated by the light sources in the base and provide a pleasing and exciting glowing effect to the drawings. Additionally, the dome may be rotated about the base in order to provide an animated view of the drawings on the dome with respect to the plate.

BRIEF DESCRIPTION OF THE DRAWINGS

Illustrative embodiments of the invention are described in detail below with reference to the attached drawing figures, and wherein.

DETAILED DESCRIPTION

Figure 1:
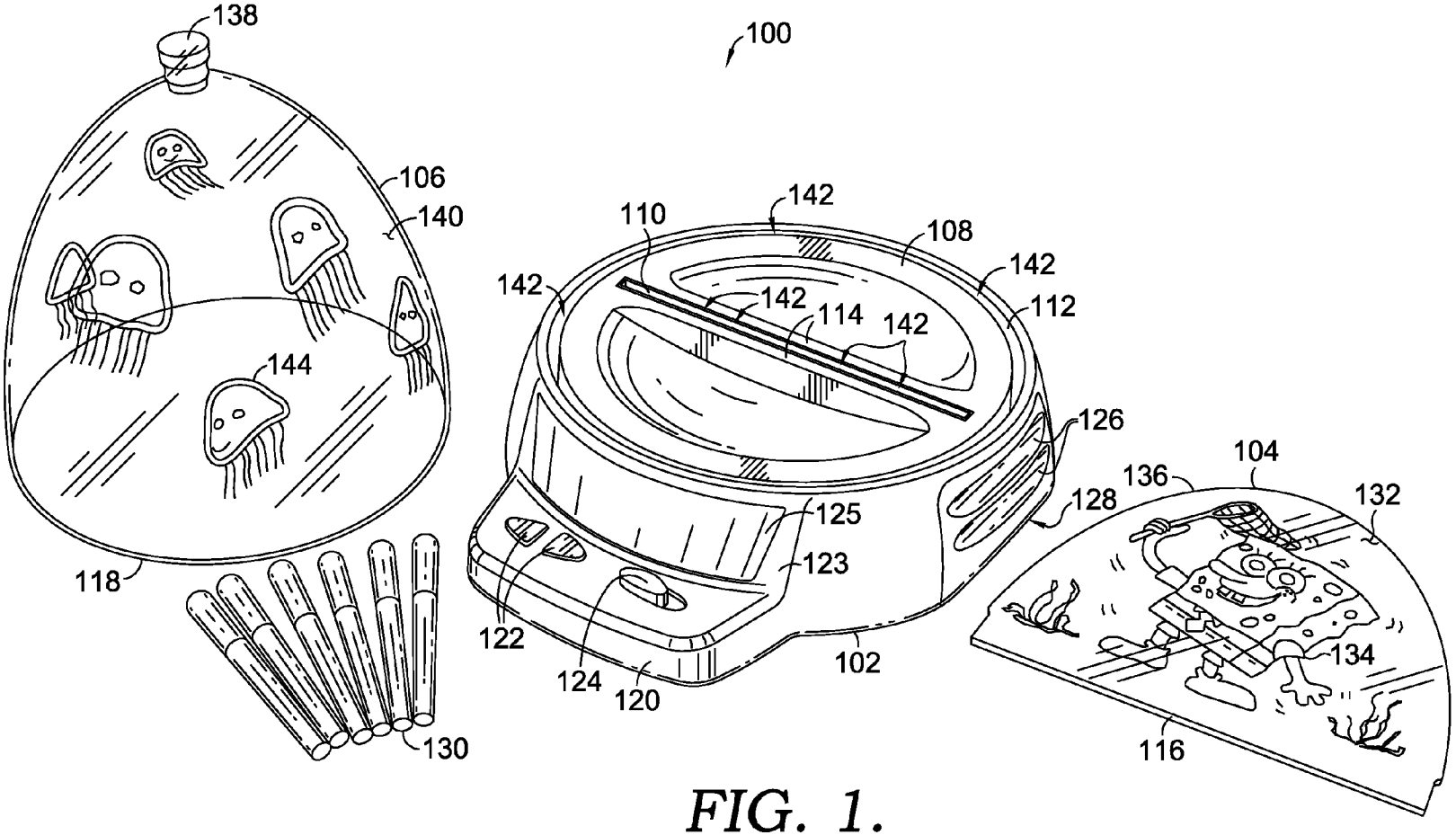
FIG. 1 is a perspective view depicting components of an illuminated-display unit in an unassembled condition in accordance with an embodiment of the invention.

The subject matter of embodiments of the invention is described with specificity herein to meet statutory requirements. But the description itself is not intended to necessarily limit the scope of claims. Rather, the claimed subject matter might be embodied in other ways to include different steps or components or combinations thereof similar to the ones described in this document, in conjunction with other present or future technologies. Terms should not be interpreted as implying any particular order among or between various steps herein disclosed unless and except when the order of individual steps as explicitly described.

Embodiments of the invention are directed to an illuminated-display unit and methods for illuminating a drawing. In an embodiment, an illuminated-display unit is described. The illuminated-display unit includes a base including a top surface that includes a receptacle and an annular channel. The base also includes light sources disposed within the base. The illuminated-display unit also includes a plate configured to be at least partially disposed within the receptacle. The plate has a generally planar shape and includes surface properties suitable to at least temporarily accept an ink thereon. A dome is also disposed atop the top surface of the base and engages the annular channel. The dome has a hollow domed structure configured to accept the plate therein and has surface properties suitable to at least temporarily accept the ink thereon.

In another embodiment, a method for illuminating a drawing is described. An illuminated-display unit is provided that includes a base with a top surface having a receptacle and an annular channel and light sources disposed within the base. The illuminated-display unit also includes a plate configured to be at least partially disposed within the receptacle, has a generally planar shape, and includes surface properties suitable to at least temporarily accept an ink thereon. The illuminated-display unit also includes a dome that is disposable atop the top surface of the base and engages the annular channel. The dome has a hollow domed structure configured to accept the plate therein and has surface properties suitable to at least temporarily accept the ink thereon. The ink is applied to surfaces of the plate and dome. The plate is inserted into the receptacle of the top surface of the base. The dome is disposed over the plate and engages the annular channel. The light sources in the base are illuminated.

In another embodiment, an illuminated-display unit is described. The illuminated-display unit includes a base including a top surface having a receptacle and an annular channel, a control panel on an exterior surface having components for controlling light sources housed within the base. A plate that is disposed within the receptacle, has a generally planar shape and comprises a material with surface properties suitable to at least temporarily accept an ink thereon is also included. Additionally, the illuminated-display unit includes a dome rotatably disposed atop the top surface of the base and engages the annular channel. The dome has a hollow domed structure configured to accept the plate therein and comprises a material with surface properties suitable to at least temporarily accept the ink thereon. The ink is disposed on a surface of the plate and/or dome. The light sources illuminate the ink on the one plate and dome. And the dome is manually or mechanically rotated atop the base.

Figure 2:
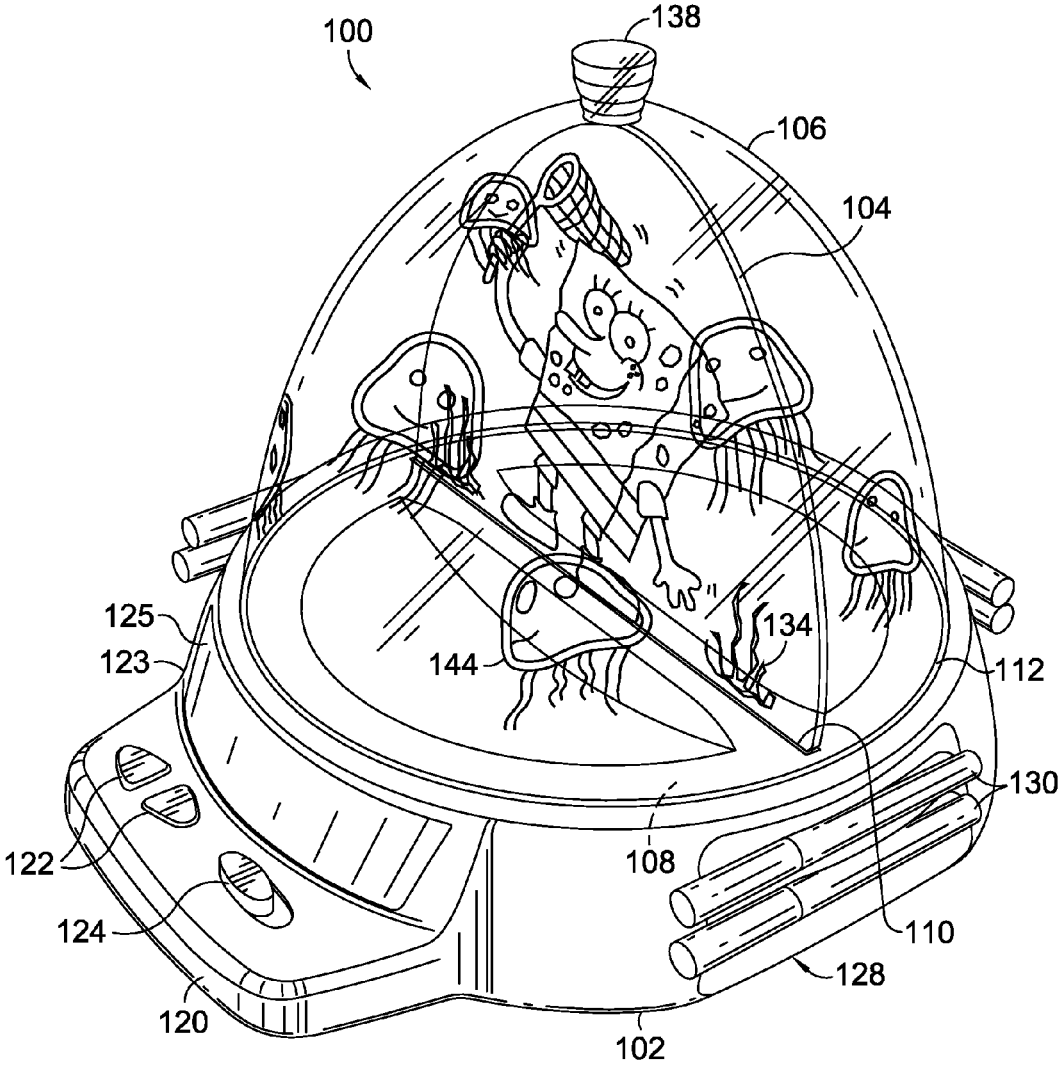
FIG. 2 is a perspective view of the illuminated-display unit of FIG. 1 in an assembled condition in accordance with an embodiment of the invention.
Figure 3:
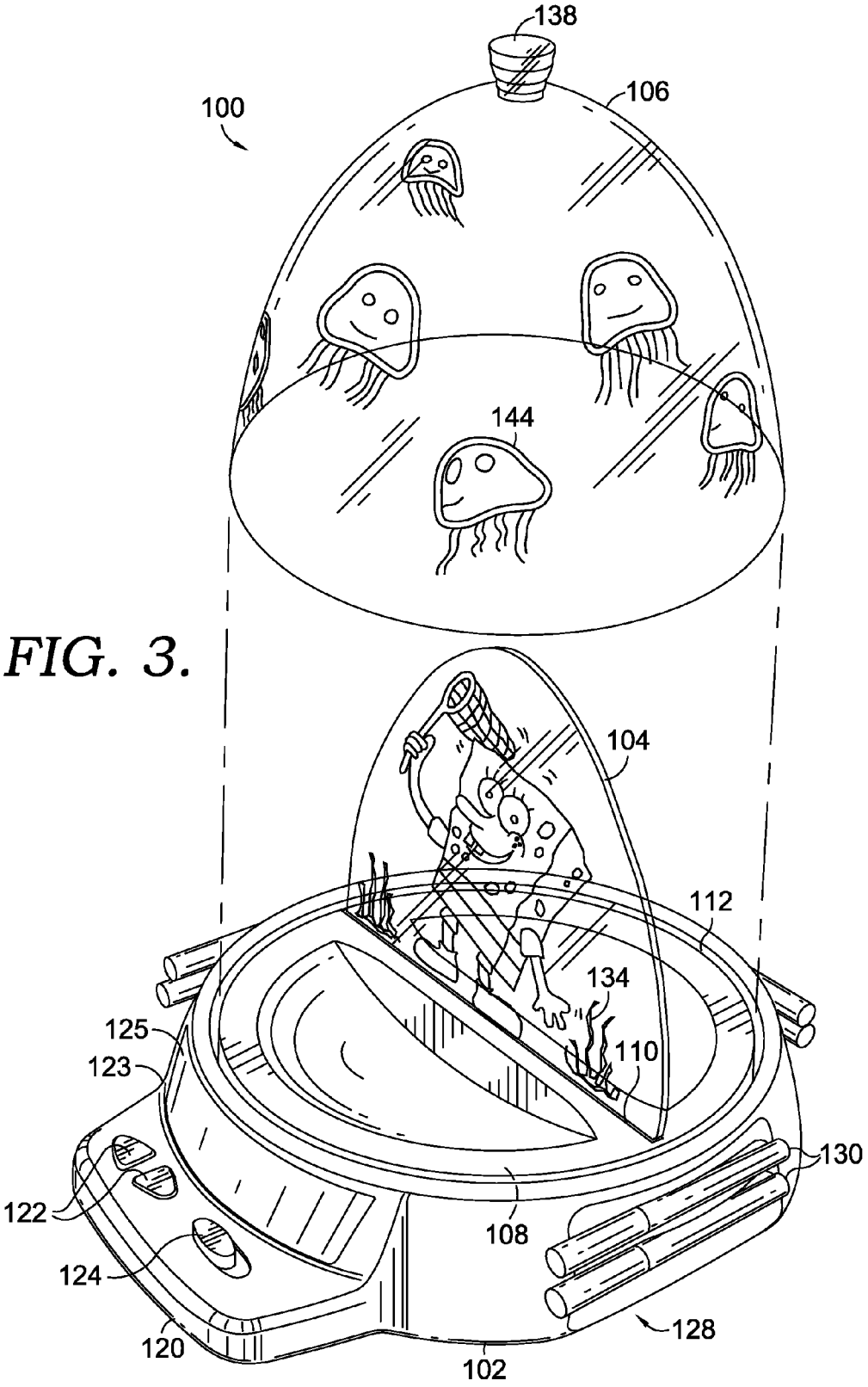
FIG. 3 is a perspective view depicting the illuminated-display unit of FIGS. 1 and 2 with a dome detached from a base in accordance with an embodiment of the invention.

With reference now to the figures, and in particular FIGS. 1-3, an illuminated-display unit 100 is described in accordance with an embodiment of the invention. Illuminated-display unit 100 (hereinafter "unit 100") includes a base 102, a plate 104, and a dome 106. The base 102 is a generally cylindrically shaped unit having any desired height and a diameter generally larger than the diameter of the dome 106. The base 102 includes a platform 108 on a top surface having a receptacle 110 formed therein and forming an annular channel 112 between an outer perimeter of the platform and an inner perimeter of the base 102.

Ridges 114 are included on each side of the receptacle 110 in order to form the sides of the receptacle 110 and/or to reinforce the receptacle 110. The receptacle 110 is of sufficient dimensions to accept a bottom edge 116 of the plate 104 and to retain the plate 104 in a generally vertical orientation perpendicular to the platform 108. One or more light sources are housed within the base 102 and are exposed along a bottom surface of the receptacle 110 in order to illuminate the plate 104 as described below. The light sources are composed of any light source available in the art include, for example, and not limitation, incandescent lights, light emitting diodes, fluorescent lights, and the like.

The annular channel 112 formed about the platform 108 is of sufficient dimensions to accept a bottom edge 118 of the dome 106, a sufficient distance to hinder lateral movement of the dome 106 with respect to the base 102. One or more lights are housed in the base 102 and are exposed along a bottom surface of the channel 112 such that when illuminated, the lights transmit light into the bottom edge 118 of the dome 106. The channel 112 may also include one or more roller bearings, ball bearings, or other bearing or reduced-friction surfaces to allow the bottom edge 118 of the dome 106 to slide within channel 112 to produce rotational movement of the dome 106. In an embodiment, the channel 112 includes a means for mechanically rotating the dome 106 with respect to the base 102, such as for example a motor coupled to one or more drive wheels, gears, cogs exposed within the channel 112 and contacting the dome 106 when placed on the base 102. In an embodiment, the light source(s) are housed within the base 102 and optical wave guides, fiber optics, or the like are employed to direct light from the light source to the channel 112 for transmission into the dome 106 or into the receptacle 110 for transmission into the plate 104.

The base 102 also includes, on an exterior surface, a control panel 120 that protrudes a distance from the exterior surface of the base 102. The control panel includes one or more buttons 122 and switches 124 for controlling one or more of lighting of the plate 104 and dome 106 and motion of the dome 106. The buttons 122 and the switch 124 include any buttons or switches known in the art including momentary buttons and toggle switches, among others, which are suitable for use in activating and deactivating lights or motors housed within the base 102. The control panel 120 also includes a front panel 123 on which a label 125 is placed.

The base further includes, equally spaced at three locations around the circumference of the exterior surface of the base, recesses 126 and scallops 128. The recesses 126 extend in a lateral direction perpendicular to the height of the base 102. The recesses 126 are each configured to removably accept a marker 130. As such, a marker 130 is inserted into a recess 126 for storage while not in use.

The markers 130 comprise a dry-erase marker having ink characteristics and drawing characteristics suitable for use with the plate 104 and the dome 106. The markers 130 include an ink of a predetermined composition that does not mar or stain the plate 104 or the dome 106 after prolonged exposure or repetitive use of the markers on the plate 104 and the dome 106. Further, the markers 130 utilize an ink composition that is easily erasable from the plate 104 and the dome 106 such that drawings may be placed on the plate 104 and the dome 106 and easily erased or removed therefrom. The markers 130 are described herein as dry-erase markers so as not to distract from the explanation of embodiments of the invention, however, this is not intended to limit embodiments of the invention to use of dry-erase markers. Any compatible marking device is useable and is contemplated in embodiments of the invention.

The scallops 128 are located beneath the recesses 126 around the circumference of the base 102. The scallops 128 provide an easily graspable portion of the base 102 to allow a user to grip and lift the base 102 from a surface.

The plate 104 comprises a flat section of material having sufficient dimensions to be received by receptacle 110 of the base 102 and to fit within the interior of the dome 106. The plate 104 thus has a straight bottom edge 116 and a curved upper edge 136 that mimics the interior shape of the dome 106. In an embodiment, the curved upper edge 136 is parabolic in shape. The plate surface 132 is a broad, flat surface upon which a user uses the markers 130 to draw one or more images, pictures, or other drawings thereon (hereinafter "drawings"). In an embodiment, the plate has any desired form or shape. The plate 104 has two opposite sides, each of which comprises a flat plate surface 132 upon which a user may draw.

The dome 106 is a hollow parabolic dome having a circumference at the bottom edge 118 sufficient to be received by the channel 112 of the base 102. Alternatively, the dome 106 may have any dome shape, such as for example and not limitation, elliptical, saucer, spherical, or any other dome shape suitable for use in embodiments of the invention. The interior of the dome 106 is of sufficient size and dimension to accept the plate 104 therein. The dome 106 further includes a knob 138 located at an apex or at the top of the dome 106 on an exterior surface. The knob 138 is of any configuration suitable for use in allowing a user to grasp the knob to lift and/or rotate the dome 106 on the base 102. The dome 106 also includes an outer surface 140 on which a user places one or more drawings. The dome 106 and the plate 104 are comprised of a polycarbonate clear plastic, but may be comprised of any clear material such as, for example and not limitation, acrylics, glass, or any other suitable material. In an embodiment, the dome 106 is tinted or has one or more translucent or opaque sections.

With continued reference to FIGS. 1-3, the operation of the unit 100 is described in accordance with an embodiment of the invention. Initially, a user draws one or more drawings on the plate surface 132 of the plate 104 using the markers 130. The user also draws one or more drawings on the outer surface 140 of the dome 106. The bottom edge 116 of the plate 104 is inserted into the receptacle 110 of the base 102. The receptacle 110 accepts the bottom edge 116 of the plate 104 a sufficient distance to support the plate 104 in a generally vertical orientation. The dome 106 is placed over the plate 104 and accepts the plate 104 within the interior of the dome 106, as depicted best in FIG. 2. Also as depicted in FIG. 2, the markers 130 are coupled to the base 102 via the recesses 126 in order to store the markers 130 until later use.

A user activates one or more light sources housed within the base and exposed along a bottom surface of the channel 112 and the receptacle 110 using the buttons 122 and the switch 124. The location of the one or more lights is generally indicated in FIG. 1 at locations 142. The location of the lights with respect to the bottom edges 116 and 118 of the plate 104 and the dome 106 respectively allows the light to be transmitted into the plate 104 and the dome 106. The light is directed within the materials of the plate 104 and the dome 106 via internal reflection of the light by the material. In an embodiment, the plate 104 and the dome 106 provide total internal reflection of the light. As such, the plate 104 and the dome 106 are not substantially illuminated by the light and remain substantially dark or transparent. Further, where a user has provided drawings 134 and 144 on the surfaces 132 and 140 of the plate 104 or the dome 106 respectively the ink on the surfaces 132 and 140 is illuminated by refracting at least a portion of the light passing through the plate 104 and the dome 106 out of the plate 104 or dome 106 and provides a glowing effect. As such, when viewed in low ambient light conditions as depicted in FIG. 3, the drawings appear to glow in the dark.

The light sources included within the base 102 provide light within a predetermined spectrum or range of wavelengths that is suitable to illuminate the ink of the markers 130. Such wavelengths may be in the blue region of the visible light spectrum or any other visible or non-visible spectrums of light. As such, the lights may illuminate the ink of the markers 130 by reflection of all or a portion of the light from the ink on the plate 104 or dome 106, or the light may cause, produce, or catalyze a physical or chemical reaction in the ink which releases energy in the form of light. The light sources are light emitting diodes (LEDs), halogen lights, incandescent lights, black lights, or any other light technology. Further, the light sources may be of a single color such as blue, or may be multicolored, among various other configurations.

Lighting of the dome 106 and the plate 104 may take on many different configurations, including constant on or off of the light sources for both the plate 104 and the dome 106, intermittent lighting of the plate 104 and/or the dome 106, flashing of the lighting of the plate 104 and/or the dome 106, or strobing of the light sources. Additionally, light sources contained beneath the channel 112 may be sequenced in a marquee fashion such that one or more light sources are illuminated at a time and de-illuminated to create the effect of lights moving through the channel 112 about the circumference of the base 102.

As such, by providing drawings in a sufficient configuration about the dome 106, a perception of animation of the figures drawn thereon is provided. The buttons 122 and the switch 124 also control rotation of the dome 106 about the base 102. The buttons 122 and the switch 124 may activate one or more drive means within the base 102 that cause the dome 106 to rotate about a central axis on top of the base 102 in a clockwise or counterclockwise direction. Alternatively, the dome 106 may be rotated manually via the knob 138 at the apex of the dome 106. In another embodiment, the plate 104 is also provided with rotational motion either manually or mechanically to provide an additional source of animated viewing.

Figure 4A:
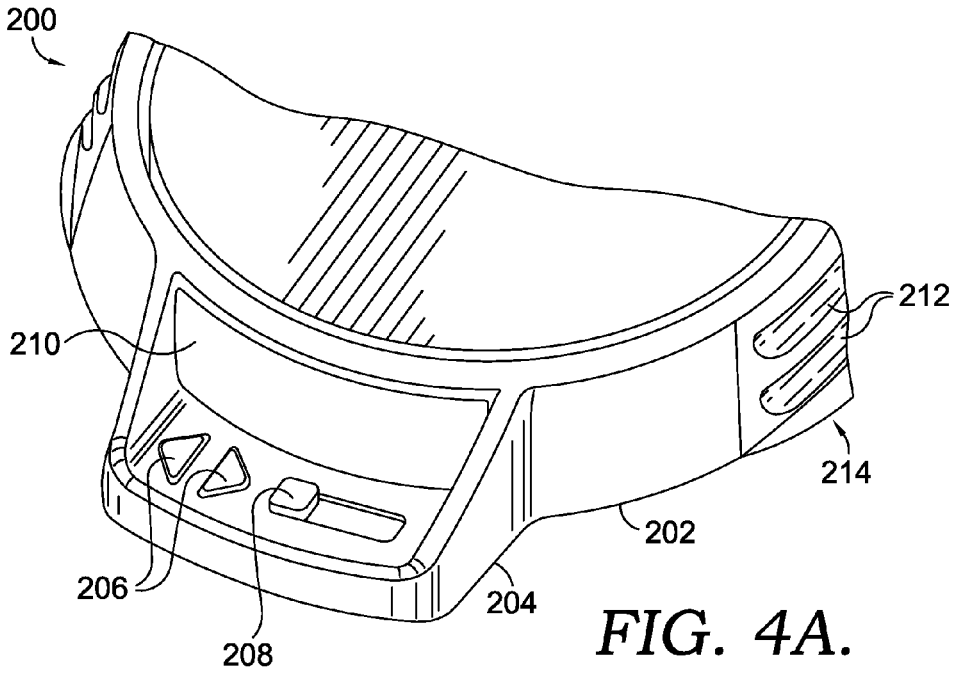
FIG. 4A is a perspective view of a base of an illuminated-display unit in accordance with an embodiment of the invention.
Figure 4B:
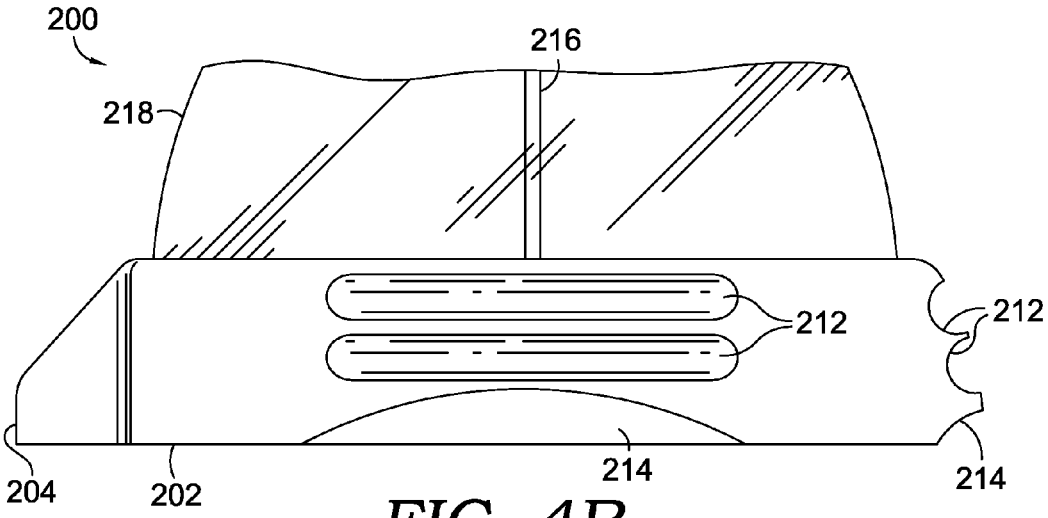
FIG. 4B is a side elevational view depicting an illuminated-display unit in accordance with an embodiment of the invention.
Figure 5:
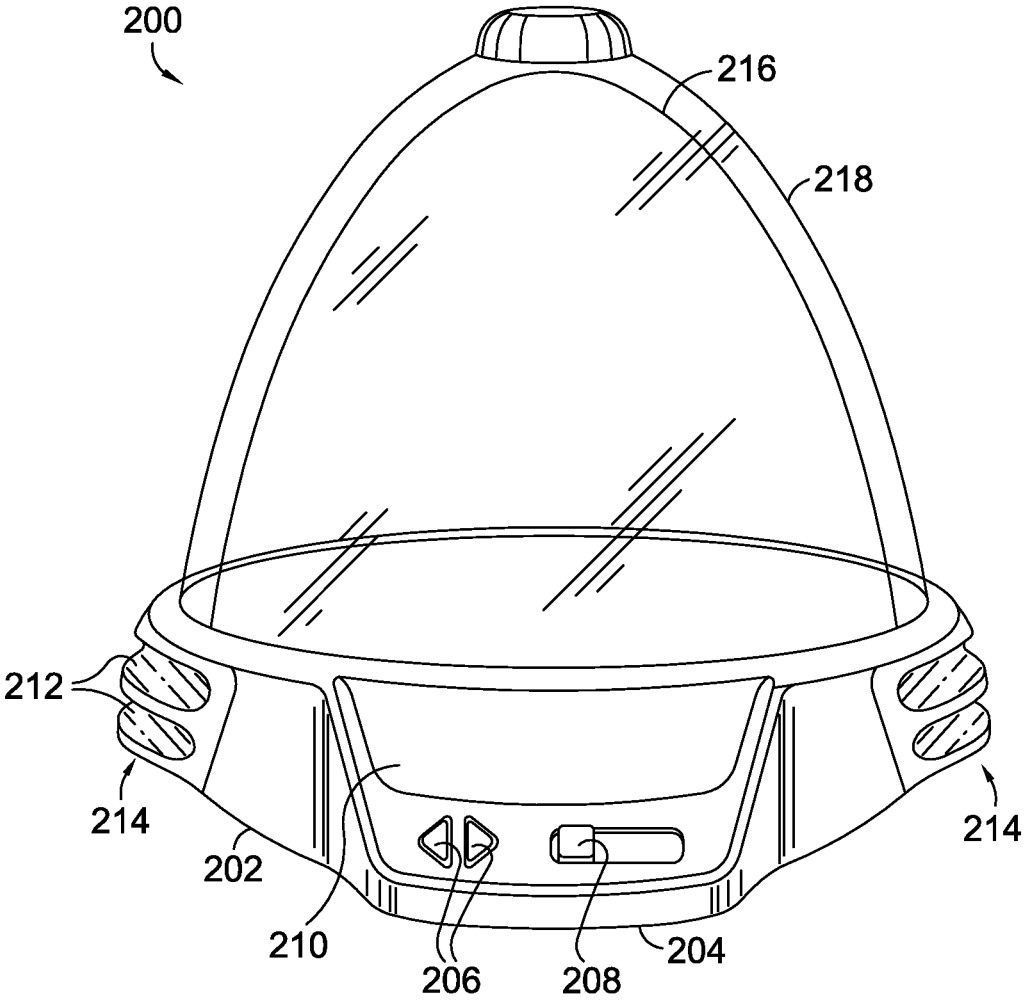
FIG. 5 is a front perspective view of an illuminated-display unit in accordance with another embodiment of the invention.

With reference now to FIGS. 4A, 4B, and 5, an illuminated-display unit 200 is described in accordance with an embodiment of the invention. The illuminated-display unit 200 is similar to and operates in a similar fashion as the unit 100. Illuminated-display unit 200 includes a base 202 having a somewhat different configuration than base 102 of the unit 100. The base 202 of the illuminated-display unit 200 includes a control panel 204 having buttons 206 and a switch 208. The control panel 204 also includes a front panel 210 upon which a label is applied. The control panel 204 is configured differently from that of the control panel 120 of the unit 100 in order to provide a modified appearance to the base 202.

The base 202 also includes recesses 212 and scallops 214 as described above with respect to the unit 100. Additionally, illuminated-display unit 200 includes a plate 216 and a dome 218, also as described previously. Each of the components 202-216 of the unit 200 operate as described above with respect to the unit 100.

Figure 6A:
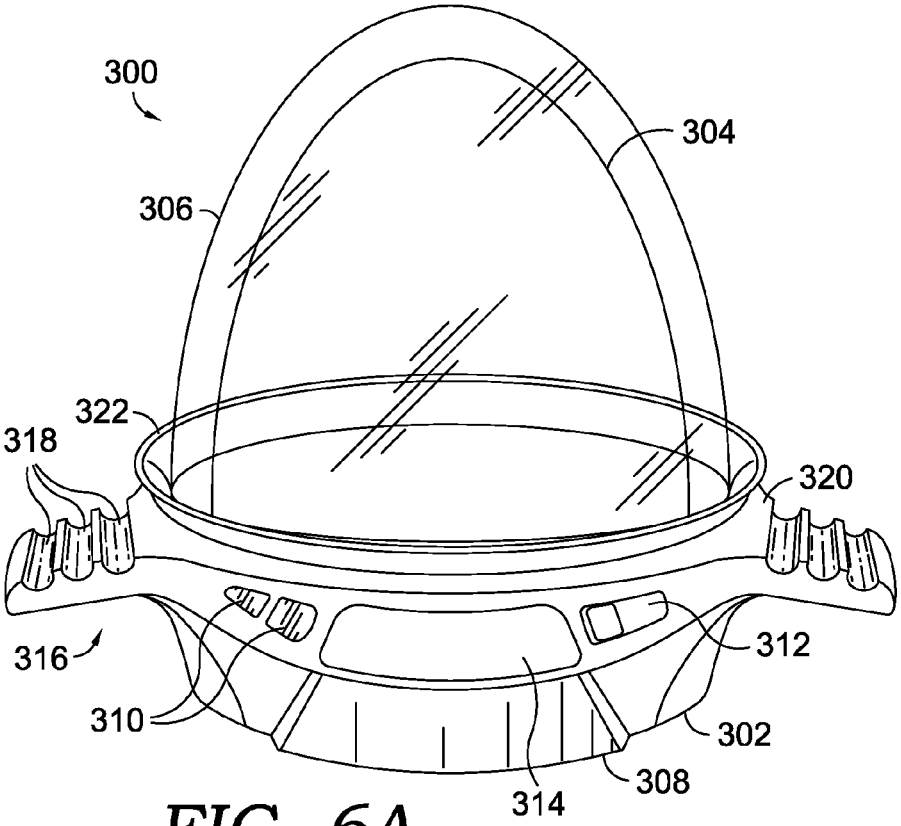
FIG. 6A is a front perspective view of an illuminated-display unit configured to resemble a spaceship in accordance with an embodiment of the invention.
Figure 6B:
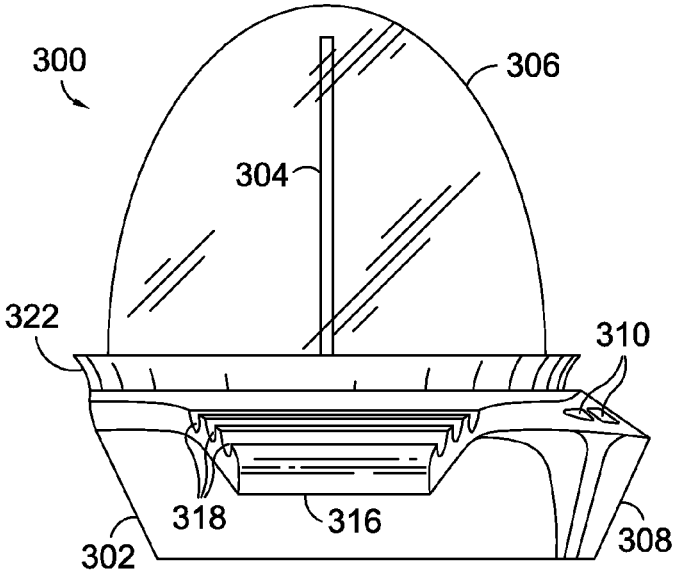
FIG. 6B is a side elevational view of the illuminated-display unit of FIG. 6A in accordance with an embodiment of the invention.

With reference now to FIGS. 6A and B, an illuminated-display unit 300 is described in accordance with an embodiment of the invention. Illuminated-display unit 300 includes a base 302, a plate 304, and a dome 306. The base 302 is configured to resemble a rocket ship or a spaceship and has a control panel 308, buttons 310, a switch 312, and a front panel 314. The base 302 also includes handles 316 configured to resemble fins or wings on a rocket ship or a spaceship. The handles 316 also include on an upper surface a plurality of recesses 318 extending in a lateral direction perpendicular to the height of the base 302 and configured to removably couple to one or more markers (not shown) and to retain them while not in use. Each of the components 308-318 of the base 302 function and operate similarly to those described for illuminated-display units 100 and 200.

The base 302 also includes along an upper surface 320 a thumb ring 322. The thumb ring 322 forms at least a portion of a channel (not shown) such as channel 112 of the unit 100 for receiving a bottom edge (not shown) of the dome 306. As such, the thumb ring 322 removably couples to the dome 306 when the dome 306 is placed atop the base 302. The thumb ring 322 is rotatably coupled to the base 302. Thus, a user rotates the thumb ring 322 in a clockwise or counterclockwise direction about base 302 in order to rotate the dome 306 in a clockwise or counterclockwise motion about the base 302.

The plate 304 is similar in configuration to that described with respect to plate 104 of the unit 100. The dome 306 is also similarly configured to the dome 106 of the unit 100, except that no knob is present on the dome 306.

In operation, the illuminated-display unit operates similarly to that of the unit 100, including the operation of buttons 310 and the switch 312. Illumination of the plate 304 and the dome 306 also occur similarly, and rotational movement of the dome 306 may be provided by mechanical means included in the base 302 or by manual means by manipulating the thumb ring 322.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading the disclosure. Alternative means of implementing the aforementioned can be completed without departing from the scope of the invention. Certain features and sub-combinations are of utility and may be employed without reference to other features and sub-combinations and are contemplated.

What is claimed is:

1. An illuminated-display unit comprising:

a base including a platform on a top surface of the base, said platform having an outer perimeter and including a at least a portion of a receptacle, and further wherein the base comprises an inner perimeter and an annular channel, wherein the annular channel is formed between the outer perimeter of the platform and the inner perimeter of the base, said base also including one or more light sources disposed within said base;

a plate configured to be at least partially disposed within said receptacle, the plate having a generally planar shape and comprising a straight bottom edge, a curved upper edge, a first drawing surface, and a second drawing surface, said plate including surface properties suitable to at least temporarily accept an ink thereon, wherein the curved upper edge is parabolic in shape, wherein the at least a portion of a receptacle is configured to accept the straight bottom edge of the plate at a sufficient distance to support the plate in a generally vertical orientation; and a hollow parabolic dome disposed atop said top surface of said base and engaging said annular channel, said hollow parabolic dome having a hollow domed structure configured to accept said curved upper edge of said plate therein and having surface properties suitable to at least temporarily accept said ink thereon, said dome comprising a bottom edge around a perimeter of the dome and a third drawing surface, wherein the annular channel is configured to accept the bottom edge of the dome such that the bottom edge of the dome is disposed atop said top surface of the base, wherein the parabolic shape of the curved upper edge of the plate corresponds to an interior shape of the hollow parabolic dome such that the curved upper edge of the plate mates to the interior shape of the hollow parabolic dome when the hollow parabolic dome is disposed atop the top surface of the base, wherein the one or more light sources are configured to illuminate said ink on one or more of the first drawing surface, the second drawing surface, and the third drawing surface based on a location of the one or more light sources with respect to one or more of the receptacle and the annular channel.

2. The illuminated-display unit of claim 1, wherein said dome is rotatably disposed atop said top surface and is one of manually or mechanically rotateable.

3. The illuminated-display unit of claim 1, wherein said platform of said top surface of said base is manually or mechanically rotateable to rotate said plate with respect to said base.

4. The illuminated-display unit of claim 2, wherein said top surface of said base is manually or mechanically rotateable to rotate said plate with respect to said base and said dome and said plate are rotated in the same or different directions.

5. The illuminated-display unit of claim 1, wherein said ink is disposed on a surface of said plate and on a surface of said dome.

6. The illuminated-display unit of claim 1, wherein said one or more light sources housed within said base illuminate said ink on one or more of said plate and said dome.

7. The illuminated-display unit of claim 6, wherein said light sources are exposed along a surface of at least one of said receptacle and said annular channel or a light guiding material channels light from one or more of said light sources to at least one of said receptacle and said annular channel, said light guiding material being exposed in said at least one of said receptacle and said annular channel.

8. The illuminated-display unit of claim 6, wherein said illuminated ink provides a glow-in-the-dark effect.

9. The illuminated-display unit of claim 8, wherein light from said one or more light sources is internally reflected within one or more of said dome and said plate and said glow-in-the-dark effect is produced by one or more of refraction of said light from one or more of said dome or said plate, a chemical reaction in said ink resulting from exposure of said ink to said light, or a physical reaction in said ink resulting from exposure of said ink to said light.

10. The illuminated-display unit of claim 1, further comprising:

a control panel on an exterior surface having one or more components for controlling said one or more light sources.

11. The illuminated-display unit of claim 10, wherein said light sources one or more of strobe, illuminated in an ordered or random sequence, or illuminate in a marquee fashion.

12. The illuminated-display unit of claim 1, wherein said ink is a dry-erase ink.

13. A method for illuminating a drawing, the method comprising:

providing an illuminated-display unit that includes:

1) a base with a platform on a top surface of the base, said platform comprising an outer perimeter and a receptacle, wherein the base comprises an inner perimeter and an annular channel, and said base including one or more light sources disposed within said base, wherein the annular channel is formed between the outer perimeter of the platform and the inner perimeter of the base, 2) a plate configured to be at least partially disposed within said receptacle, the plate having a generally planar shape and including surface properties suitable to at least temporarily accept an ink thereon, wherein the plate comprises a curved upper edge, a straight bottom edge, a first drawing surface, and a second drawing surface, said curved upper edge being parabolic in shape, and 3) a hollow parabolic dome disposable atop said top surface of said base and engaging said annular channel having a hollow parabolic domed structure configured to accept said plate therein and comprising surface properties suitable to at least temporarily accept said ink thereon, wherein the dome comprises a bottom edge around a perimeter of the dome and a third drawing surface, wherein the annular channel is configured to accept the bottom edge of the dome such that the bottom edge of the dome is disposed atop said top surface of the base, wherein the parabolic shape of the curved upper edge of the plate is configured to mate to the hollow parabolic domed structure when the bottom edge of the hollow parabolic domed structure is disposed atop the top surface of the base and the straight bottom edge of the plate is coupled to the receptacle at a sufficient distance to support the plate in a generally vertical orientation;

applying said ink to one or more drawing surfaces of one or more of said plate and said dome;

inserting at least a portion of said plate into said receptacle of said top surface of said base;

disposing said dome over said plate and engaging said annular channel; and illuminating at least one of said one or more light sources in said base.

14. The method of claim 13, further comprising:

rotating said dome with respect to said base, wherein said rotation is done manually or mechanically.

15. The method of claim 13, wherein said dome is manually rotated by using one or more of a handle at an apex of said dome and a thumb ring coupled to said annular channel.

16. The method of claim 13, further comprising:

rotating said plate with respect to said base, wherein said rotation is done manually or mechanically.

17. The method of claim 14, further comprising:

rotating said plate with respect to said base, wherein said rotation is done manually or mechanically, and wherein said dome and said plate rotate in the same or different directions.

18. The method of claim 13, wherein illuminating at least one of said one or more light sources supplies light to one or more of said plate and said dome, said light is internally reflected within one or more of said plate and said dome, and said light causes said ink to provide a glowing effect by one or more of refraction of said light from one or more of said plate and said dome, a chemical reaction in said ink resulting from exposure of said ink to said light, or a physical reaction in said ink resulting from exposure of said ink to said light.

19. An illuminated-display unit comprising:

a base including a top surface having a receptacle and an annular channel, a control panel on an exterior surface having one or more components for controlling one or more light sources, and said one or more light sources housed within said base;

a plate at least partially disposed within said receptacle, having a generally planar shape and comprising a material with surface properties suitable to at least temporarily accept an ink thereon, wherein the plate comprises a curved upper edge, a straight bottom edge, a first drawing surface, and a second drawing surface, said curved upper edge being parabolic in shape;

a hollow parabolic dome rotatably disposed atop said top surface of said base and engaging said annular channel having a hollow parabolic domed structure configured to accept said plate therein and comprising a material with surface properties suitable to at least temporarily accept said ink thereon, wherein said dome comprises a third drawing surface and a bottom edge around a perimeter of a body of the dome having a greatest circumference of the body of the dome, wherein the annular channel is configured to accept the bottom edge of the dome such that the bottom edge of the dome is disposed atop said top surface of the base, wherein the parabolic shape of the curved upper edge of the plate is configured to mate to an interior of the hollow parabolic domed structure when the bottom edge of the hollow parabolic domed structure is disposed atop the top surface of the base and the straight bottom edge of the plate is coupled to the receptacle at a sufficient distance to support the plate in a generally vertical orientation;

wherein said ink is disposed on one or more of a drawing surface of said plate and a drawing surface of said dome;

wherein said one or more light sources housed within said base illuminate said ink on said one or more of said plate and said dome; and wherein said dome is one of manually or mechanically rotated atop said base.

20. The illuminated-display unit of claim 19, wherein said illuminated ink provides a glow-in-the-dark effect.

* * * * *